US005602520A

United States Patent [19]

Baiatu et al.

[11] Patent Number: 5,602,520

[45] Date of Patent: Feb. 11, 1997

[54] ELECTRICAL RESISTANCE ELEMENT AND USE OF THIS RESISTANCE ELEMENT IN A CURRENT LIMITER

[75] Inventors: Tudor Baiatu, Brugg; Felix Greuter, Baden-Rütihof; Ralf Strümpler, Baden, all of Switzerland

[73] Assignee: ABB Research Ltd., Zurich, Switzerland

[21] Appl. No.: 291,903

[22] Filed: Aug. 18, 1994

[30] Foreign Application Priority Data

Aug. 25, 1993 [EP] European Pat. Off. ..... 93113545

[51] Int. Cl.[6] ..... H01C 7/10

[52] U.S. Cl. ..... 338/22 R; 338/225 D

[58] Field of Search ..... 338/225 D, 22 R, 338/20, 212, 214; 219/503, 535, 541; 252/510, 511; 156/85, 86

[56] References Cited

U.S. PATENT DOCUMENTS

| | | | |
|---|---|---|---|
| 4,486,737 | 12/1984 | Ott | 338/22 R |
| 4,545,926 | 10/1985 | Fouts, Jr. et al. | 252/511 |
| 4,560,498 | 12/1985 | Horsma et al. | 252/511 |
| 4,743,321 | 5/1988 | Soni et al. | 156/85 |
| 4,801,784 | 1/1989 | Jensen et al. | 219/548 |
| 5,190,697 | 3/1993 | Ohkita et al. | 252/511 |
| 5,414,403 | 5/1995 | Greuter et al. | 338/22 R |

FOREIGN PATENT DOCUMENTS

| | | |
|---|---|---|
| 0363746 | 4/1990 | European Pat. Off. . |
| 0548606A2 | 6/1993 | European Pat. Off. . |

*Primary Examiner*—Tu Hoang

*Attorney, Agent, or Firm*— Burns, Doane, Swecker & Mathis, L.L.P.

[57] ABSTRACT

The electrical resistance element (10) includes a resistance body (3), which is arranged between two plane-parallel, pressurized electrodes (1, 2), has PTC behavior and comprises a polymer matrix and two filler components of electrically conducting particles embedded into the polymer matrix (4).

When a short-circuit current occurs, the resistivity of the resistance body (3) changes abruptly above a temperature limit value in a surface layer resting on the electrodes and containing at least a first of the two filler components. A second of the two filler components is selected such that a composite material containing at least the polymer matrix and the second filler component has PTC behavior, with an abruptly changing behavior greater by at least one order of magnitude in comparison with the surface layer. At the same time, this composite material has a resistivity which is lower by at least one order of magnitude than a composite material formed by the polymer matrix and the first filler component.

The resistance element has a high nominal current carrying capacity and can limit large short-circuit currents permanently.

25 Claims, 1 Drawing Sheet

ELECTRICAL RESISTANCE ELEMENT AND USE OF THIS RESISTANCE ELEMENT IN A CURRENT LIMITER

BACKGROUND OF THE INVENTION

1. Field of the Invention

The invention is based on an electrical resistance element. The invention also relates to the use of such a resistance element in a current limiter.

2. Discussion of Background

A resistance element of the type mentioned at the beginning is known from EP 0 363 746 A1 and from the paper by T. Hansson "Polyäthylen-Stromwächter für den Kurzschlußschutz" [Polyethylene current relay for short-circuit protection], published in ABB Technik 4/92 (1992), pp. 35–38. This resistance element comprises a thin plastic plate of filler-containing polyethylene, which is arranged between two comparatively thick electrodes. At room temperature, this resistance element has a very low resistance and can then carry the nominal current flowing in a low-voltage distribution network without any problem. For several seconds, the resistance element can also readily carry a nominal current several times higher, since the comparatively thick electrodes can temporarily absorb the Joulean heat generated in the resistance element. If, on the other hand, a short-circuit current occurs, the temperature of the resistance element increases very rapidly in a very thin surface layer at the electrodes, preferably consisting of silver-plated copper, and melts the polyethylene located in this layer. As a result, the resistance of the resistance element increases abruptly and reaches about 30 times its initial value in less than one millisecond. The short-circuit current is thereby greatly reduced and can be disconnected by a power circuit-breaker of low short-circuit breaking capacity, connected in series with the resistance element.

SUMMARY OF THE INVENTION

Accordingly, one object of the invention is to provide an electrical resistance element of the type mentioned at the beginning which can limit short-circuit currents permanently. It is at the same time also an object of the invention for this resistance element to be used in a current limiter for nominal voltages of at least 500 V.

The electrical resistance element according to the invention can be produced from commercially available components, such as a polymer matrix and a suitable filler, in a simple and inexpensive way. In the low-resistance state, it has a lower resistivity than the resistance element according to the prior art and therefore, given the same geometrical dimensions, can carry greater nominal currents. In addition, such a resistance element can disconnect short-circuit currents even without an additional suppressor circuit, such as for instance switchgear connected in series with the resistance element.

BRIEF DESCRIPTION OF THE DRAWINGS

A more complete appreciation of the invention and many of the attendant advantages thereof will be readily obtained as the same becomes better understood by reference to the following detailed description when considered in connection with accompanying the drawings, wherein.

DESCRIPTION OF THE PREFERRED EMBODIMENTS

Figure 1:
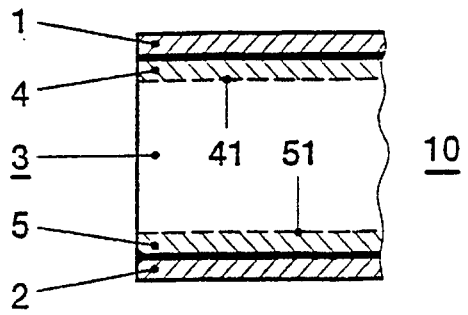
FIG. 1 shows a plan view of a section through a part of a first embodiment of the electrical resistance element according to the invention.
Figure 2:
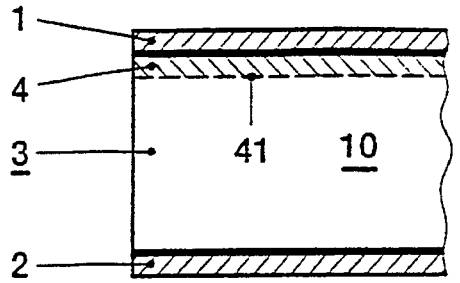
FIG. 2 shows a plan view of a section through a part of a second embodiment of the electrical resistance element according to the invention.
Figure 3:
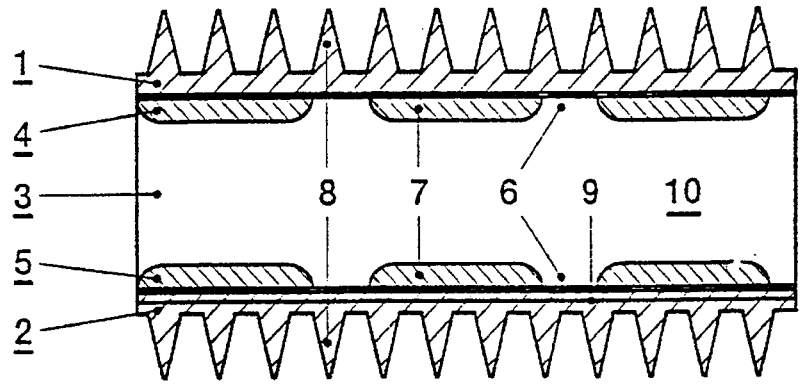
FIG. 3 shows a plan view of a section through a third embodiment of the electrical resistance element according to the invention.

Referring now to the drawings, wherein like reference numerals designate identical or corresponding parts throughout the several views, in FIGS. 1 to 3 there is a resistance element 10 which contains a resistance body 3 with PTC behavior, arranged between two plate-shaped, solid, copper-containing electrodes 1, 2. Below a transition temperature $T_c$, this resistance element 10 has a low cold resistivity and, after being fitted into a current limiter, forms a path running between the two electrodes 1, 2 and, in the normal case, carrying nominal current. Above the transition temperature $T_c$, the resistance element 10 abruptly changes its electrical conductivity and then has a hot resistivity which is large in comparison with its cold resistivity.

The resistance body 3 is formed by a polymer matrix preferably containing a thermoset or thermoplastic or an elastomer. Two filler components formed by electrically conducting particles are embedded into this matrix, typically consisting of polyethylene.

A first of these filler components is a material which—such as carbon in particular—in the case of the resistance element 10 results in the abrupt change in resistance, known from the prior art, on account of a surface layer forming when a short-circuit current occurs.

A second of these filler components is selected such that a composite material containing the polymer matrix, second filler component and, if appropriate, also the first filler component has PTC behavior, with an abruptly changing behavior of the resistance PTC transition which is greater by at least one order of magnitude in comparison with the PTC transition the surface layer. At the same time, the above-mentioned composite material has a resistivity which is lower by at least one order of magnitude than a comparative composite material formed by the polymer matrix and the first filler component, with the same amount of filler. The second filler component may be a metal, such as Ag, Au, Ni, Pd and/or Pt, and/or a boride, silicide, oxide and/or carbide, such as for instance SiC, TiC, $TiB_2$, $MoSi_2$, $WSi_2$, $RuO_2$ or $V_2O_3$, in each case in undoped or doped form. The proportion of filler is chosen to be high and may be, for example, between 30 and 50 percent by volume.

The size of the particles of the first filler component is typically up to 1 μm, that of the second filler component typically between 1 and 100 μm. Due to the fact that the average size of particles of the first filler component is smaller by at least one order of magnitude than the average size of particles of the second filler component, the particles of the first filler component are arranged in gaps between the particles of the second filler component. The second filler component can thus form at operating temperature numerous percolating current paths, necessary for a high nominal current carrying capacity. At the same time, even in the regions of the resistance body close to the surface there is an adequate amount of first filler component for forming the current-limiting surface layer.

For producing a resistance element 10 according to the invention, a shearing mixer or an extruder is used to mix the first filler component and the second filler component, advantageously carbon black and titanium diboride ($TiB_2$), into a polymer, such as in particular polyethylene. This composite is formed into the plate-shaped resistance body 3, in the case of thermoplastics by hot press molding and in the case of epoxides by casting and subsequent curing at elevated temperature. The electrodes 1, 2 of planar design are constantly pressed against the end faces of the resistance body by means of spring pressure.

In normal operation, the second fillers provided in the resistance body 3 of the resistance element 10 form low-resistance current paths passing through the resistance body 3, having a resistivity which is lower by orders of magnitude than a resistance element according to the prior art, filled with a comparable amount, but exclusively with the first filler component. In comparison with a comparably dimensioned resistance element according to the prior art, such a resistance element 10 therefore has a substantially increased nominal current carrying capacity.

When a short-circuit current occurs, the previously mentioned thin surface layer forms within one millisecond from the polyethylene and the carbon black resting on the electrodes 1, 2. This layer already reduces the short-circuit current quite considerably. The remaining part of the resistance body 3 heats up due to the still flowing short-circuit current. As soon as the temperature of the remaining part of the resistance body 3 exceeds the transition temperature $T_c$, the resistance of the resistance body increases abruptly by a plurality of orders of magnitude and permanently limits the short-circuit current, with electrical and thermal relief of the surface layer. The short-circuit current is then disconnected. The resistance element 10 then cools down and can then carry nominal current again.

This behavior of the resistance element 10 is achieved, as described above, by mixing in with the polymer suitably proportioned and dimensioned filler components. However, it can also be achieved, as represented in FIGS. 1 to 3, by at least one of the end faces of the resistance body 3 being formed by a thin layer 4 of the polymer matrix, filled with the first filler component. This layer 4 can be produced by diffusing in or pressing in carbon black into the polymer matrix without filler or already filled with the second filler component, such as in particular $TiB_2$. The layer 4 should be as thin as possible, but nevertheless thick enough to withstand a required number of short-circuit actions. The thickness of the layer 4 is typically a few μm.

The second filler component may be uniformly distributed in the polymer matrix. However, the concentration of the second filler component may also decrease gradually from the center of the resistance body toward the electrode 1 and/or 2. As a result, a particularly pronounced interface 41 is achieved between the layer 4 and the remaining layer of the resistance body 3, doped only with the second filler component.

As can be seen from FIG. 1, as a difference from the embodiment according to FIG. 2, the end face of the resistance body 3 contacted by the electrode 2 may also be designed as a thin layer, filled with the first filler component. This layer is provided with the reference numeral 5. Although such a resistance element has a slightly greater resistance in nominal current operation than the resistance element according to FIG. 2, when a short-circuit current occurs said resistance element then forms two current-limiting surface layers connected to each other in series.

The boundary layer 41 and a boundary layer 51, provided between the layer 5 and the layer doped with the second filler component, contain a metal grid and/or a sheet-like metalization. As a result, a uniform electrical field loading of the individual layers of the resistance body 3 is promoted.

In the case of the embodiment of the resistance element according to FIG. 3, the layers 4 and 5 have interruptions 6, which are filled with polymer containing only the second filler component. Such a resistance element is distinguished in comparison with the resistance element according to FIG. 1 by an increased nominal current carrying capacity. The layers 4 and 5 in this case comprise regions 7, containing the first filler component and, if appropriate, also the second filler component, which serve primarily for producing a plasma for forming the surface layer.

As can be seen from FIG. 3, the faces of the electrodes 1, 2 turned away from the resistance body 3 may bear cooling ribs 8. Instead of cooling ribs 8, each of the electrodes 1, 2 may also bear some other heat sink, for example a liquid cooler. By means of such heat sinks connected to the outer surface of at least one of the two electrodes 1, 2, the nominal current carrying capacity can be additionally increased by virtue of increased heat dissipation, As represented in FIG. 3 in the case of the electrode 2, between the electrodes and the heat sinks, for example the cooling ribs 8, there may be arranged an intermediate layer 9 of electrically insulating, but thermally highly conducting material, which serves for electrical isolation between the resistance element 10 and the heat sinks. This layer may be formed by a silicone film or a ceramic sheet, for instance based on $Al_2O_3$ or AlN, filled with filler, such as aluminum oxide, aluminum nitride and/or boron nitride.

Figure 4:
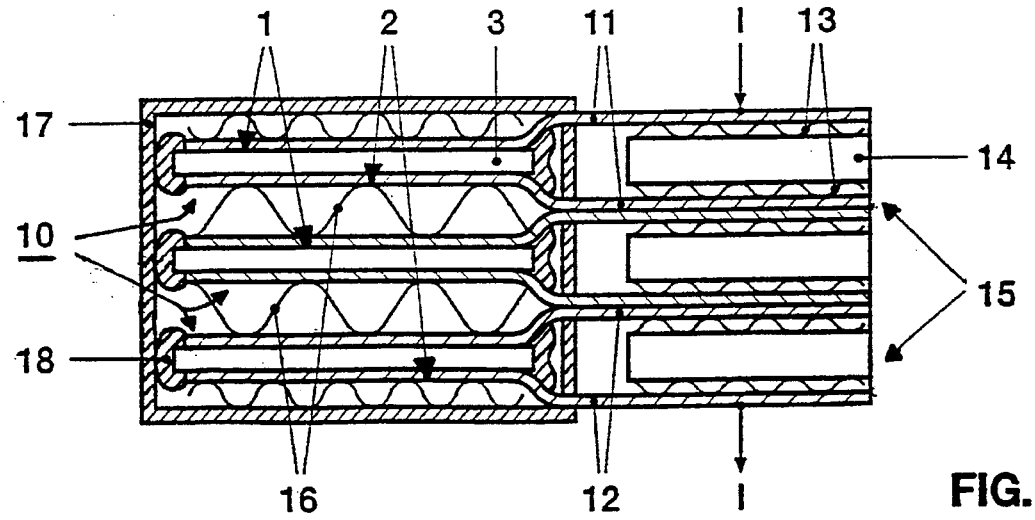
FIG. 4 shows a plan view of a section through a current limiter which is intended for a nominal voltage of 1.5 kV and into which resistance elements according to the invention are fitted.

Represented in FIG. 4 is a current limiter which can be used for nominal voltages up to 1.5 kV and in which there are used three resistance elements 10 designed according to the above embodiments and connected to one another in series. Instead of three resistance elements 10, just two or, if appropriate, four or more resistance elements may also be used. The electrodes 1, 2 of these resistance elements have extensions 11, 12. Between the two extensions 11 and 12 of the two electrodes 1, 2 there is in each case a resistor 14 clamped in a flexibly resilient manner with the aid of two resilient contact elements 13. This resistor may have a linear voltage behavior, but is advantageously a nonlinear, voltage-dependent resistor, for instance based on metal oxide.

The two electrodes 1, 2, the resistance body 3, the resistor 14 connected parallel thereto, and the two resilient contact elements 13 form a current-limiting, voltage-controlled component 15 of the current limiter, which can be used for nominal voltages up to at most 500 V. In the case of the series connection of three such components, indicated in FIG. 4, nominal voltages of up to 1.5 kV can be applied to the current limiter. Between the electrodes 1, 2 of successive components 15 there are provided in the region of the resistance bodies 3 spring elements 16, which act on the electrodes 1, 2 with pressure force and thus ensure at room temperature a reliable current path for the nominal current I. The resistance bodies 3 are accommodated in a housing 17 of insulating material, The extensions 11, 12 of the electrodes 1, 2 are led through the wall of the housing 17 of insulating material and keep the resistors 14 outside the housing. An edge termination of the resistance bodies 3 of insulating material is identified by the reference numeral 18.

In the case of this current limiter, the current initially flows in a current path formed by the extension 11 of the upper electrode 1, a series connection of the three resistance elements 10 and the extension 12 of the lower electrode 2. When a short-circuit current occurs, one of the resistance elements 10 switches first. The full system voltage of 1.5 kV is then across this resistance element and the parallel-connected resistor 14. The resistor 14 is rated such that at this voltage it becomes current-conducting, reduces the high voltage across the resistance element 10 and thus protects the latter against destruction, Then another of the two other resistance elements 10 can switch. The voltage is now distributed over two of the three resistance elements 10. With suitable rating of the resistance elements 10, overloading of the two through-connected resistance elements by the only temporarily fully effective system voltage does not have to be feared. The resistor 14, then subjected to reduced voltage loading, goes over into the nonconducting state. The current limiter then disconnects the short-circuit current once and for all.

Particles expelled during current limitation from the resistance elements 10, and containing carbon black in particular, are kept away from the nonlinear voltage-dependent resistors 14 by the housing 17 of insulating material and/or by the edge termination 18, provided if appropriate.

A particularly space-saving design of the current limiter is achieved if the resistors 14 are arranged in a step-like manner, turned with respect to one another by, for example, 90° and 180°. With a suitable design of the electrodes 1, 2 and of the intermediate insulation, the current-limiting resistance elements 10 and the resistors 14 may also be arranged one above the other. The current limiter then has a particularly easy-to-handle, column-shaped structure.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by letters patent of the United States is:

1. A current-limiting resistance element, comprising:

a resistance body;

two plane-parallel, pressurized electrodes, the resistance body being arranged between the two electrodes; and the resistance body having PTC behavior and including at least one polymer matrix and at least one first filler component of electrically conducting particles embedded into the polymer matrix, the resistivity of the resistance body increasing, at least in a surface layer of the resistance body disposed adjacent a first electrode of the two electrodes, above a temperature limit value when a short-circuit current occurs, body including, at least in a zone extending parallel to the surface layer and taking up the greatest part of its volume, a second filler component, the second filler component being embedded into the polymer matrix and being selected such that a composite material containing at least the polymer matrix and the second filler component has PTC behavior and a changing behavior at a PTC transition of the composite material which is greater by at least one order of magnitude in comparison with a PTC transition of the surface layer, and a resistivity of the composite material is lower by at least one order of magnitude than a composite material formed by the polymer matrix and the first filler component.

2. The resistance element as claimed in claim 1, wherein the first filler component and second filler component are uniformly distributed in the polymer matrix.

3. The resistance element as claimed in claim 1, wherein a concentration of the second filler component in the polymer matrix decreases from a center of the resistance body toward the first electrode.

4. The resistance element as claimed in claim 2, wherein an average size of particles of the first filler component is smaller by at least one order of magnitude than an average size of particles of the second filler component.

5. The resistance element as claimed in claim 1, wherein the resistance body has at least two layers of different electric conductivity running parallel to the electrodes, a first side of a first layer of the two layers contacting the first electrode, and a second layer of the two layers having a lower resistivity than the first layer and contacting, on a first side thereof, a second side of the first layer and contacting, on a second side of the second layer, a second electrode of the two electrodes.

6. The resistance element as claimed in claim 5, wherein the first layer is a composite material formed by the first filler component and the polymer matrix.

7. The resistance element as claimed in claim 5, wherein a boundary layer, disposed between the first layer and the second layer contains a metal grid.

8. The resistance element as claimed in claim 7, wherein the first layer has interruptions filled by the second layer.

9. The resistance element as claimed in claim 1, wherein at least one of the two electrodes is connected to a heat sink.

10. The resistance element as claimed in claim 9, wherein an electrically insulating intermediate layer of high thermal conductivity is arranged between the electrode and the heat sink.

11. The resistance element as claimed in claim 1, wherein the polymer matrix contains a thermoplastic, the first filler component contains carbon, and the second filler component contains titanium diboride.

12. A current limiter comprising:

at least two components, connected in series, each component including a resistance element, the resistance element including a resistance body, two plane-parallel, pressurized electrodes, the resistance body being arranged between the two electrodes, and the resistance body having PTC behavior and including at least one polymer matrix and at least one first filler component of electrically conducting particles embedded into the polymer matrix, the resistivity of the resistance body increasing, at least in a surface layer of the resistance body disposed adjacent a first electrode of the two electrodes, above a temperature limit value when a short-circuit current occurs, the resistance body including, at least in a zone extending parallel to the surface layer and taking up the greatest part of its volume, a second filler component, the second filler component being embedded into the polymer matrix and being selected such that a composite material containing at least the polymer matrix and the second filler component has PTC behavior and a changing behavior at a PTC transition of the composite material which is greater by at least one order of magnitude in comparison with a PTC transition of the surface layer, and a resistivity of the composite material is lower by at least one order of magnitude than a composite material formed by the polymer matrix and the first filler component; and a resistor connected in parallel to the resistance element.

13. The current limiter as claimed in claim 12, further comprising a wall of a housing of insulating material arranged between the resistance bodies and the resistors, the wall of the housing of insulating material enclosing the resistance elements of the resistors.

14. The current limiter as claimed in claim 13, wherein the electrodes of the resistance elements extend through the wall of the housing of the insulating material.

15. The resistance element as claimed in claim 1, wherein the composite material includes the first filler material.

16. The resistance element as claimed in claim 1, wherein the resistance body has at least three layers of different electric conductivity running parallel to the electrodes, a first side of a first layer of the three layers contacting the first electrode, a second layer of the three layers having a lower resistivity than the first layer and contacting, on a first side thereof, a second side of the first layer and contacting, on a second side of the second layer, a third layer, comparable with the first layer.

17. The resistance element as claimed in claim 16, wherein the first layer and the third layer are a composite material formed by the first filler component and the polymer matrix.

18. The resistance element as claimed in claim 16, wherein the first layer and the third layer are a composite material formed by a mixture of the first filler component, the second filler component and the polymer matrix.

19. The resistance element as claimed in claim 5, wherein the first layer is a composite material formed by a mixture of the first filler component, the second filler component and the polymer matrix.

20. The resistance element as claimed in claim 16, wherein two boundary layers, a first boundary layer being disposed between the first layer and the second layer and a second boundary layer being disposed between the second layer and the third layer contain a metal grid.

21. The resistance element as claimed in claim 16, wherein two boundary layers, a first boundary layer being disposed between the first layer and the second layer and a second boundary layer being disposed between the second layer and the third layer, contain a sheet-like metalization.

22. The resistance element as claimed in claim 5, wherein a boundary layer, disposed between the first layer and the second layer, contains a sheet-like metalization.

23. The resistance element as claimed in claim 16, wherein the first layer and the third layer have interruptions filled by the second layer.

24. The resistance element as claimed in claim 9, wherein the heat sink includes cooling ribs.

25. The resistance element as claimed in claim 1, wherein the thermoplastic includes polyethylene.

* * * * *